US009767967B2

(12) United States Patent
Usai et al.

(10) Patent No.: US 9,767,967 B2
(45) Date of Patent: Sep. 19, 2017

(54) SWITCH UNIT, AND RELATED METHOD

(75) Inventors: Roberto Usai, Treviolo (IT); Fabio Mannino, Curno (IT)

(73) Assignee: ABB Schweiz AG, Baden (CH)

( * ) Notice: Subject to any disclaimer, the term of this patent is extended or adjusted under 35 U.S.C. 154(b) by 1015 days.

(21) Appl. No.: 13/604,215

(22) Filed: Sep. 5, 2012

(65) Prior Publication Data

US 2013/0015712 A1 Jan. 17, 2013

Related U.S. Application Data

(63) Continuation of application No. PCT/EP2011/053391, filed on Mar. 7, 2011.

(30) Foreign Application Priority Data

Mar. 18, 2010 (EP) ..... 10156853

(51) Int. Cl.
*H01H 9/54* (2006.01)
*H01H 3/28* (2006.01)

(52) U.S. Cl.
CPC ..... *H01H 3/28* (2013.01); *H01H 9/54* (2013.01); *Y10T 307/615* (2015.04)

(58) Field of Classification Search
CPC ..... Y10T 307/615; H01H 9/54
See application file for complete search history.

(56) References Cited

U.S. PATENT DOCUMENTS 4,316,097 A * 2/1982 Reynolds ..... B66B 5/02 187/290
5,414,475 A * 5/1995 Trzyna ..... H04N 5/63 307/64
5,495,530 A * 2/1996 Peterson ..... H04M 19/08 379/413
5,513,061 A * 4/1996 Gelbien ..... H02H 7/262 361/63

(Continued)

FOREIGN PATENT DOCUMENTS

SE WO 2008132058 A1 * 11/2008 ..... H01H 33/42
WO WO 2007/108730 A1 9/2007

OTHER PUBLICATIONS

International Search Report (PCT/ISA/210) issued on Jun. 14, 2011, by the European Patent Office as the International Searching Authority for International Application No. PCT/EP2011/053391.

(Continued)

*Primary Examiner* — Thienvu Tran
*Assistant Examiner* — Pinping Sun
(74) *Attorney, Agent, or Firm* — Taft Stettinius & Hollister LLP

(57) ABSTRACT

A switch unit includes a current switching device drivable by an electromagnetic actuator for opening/closing an electric circuit associated with the switch unit, a first energy storage for storing electric energy for the electromagnetic actuator, and electronic controller means which are supplied by an external power line and control a supply of the electric energy from the energy storage means to the electromagnetic actuator. The switch unit includes emergency procedure operating means associated with the electronic controller means and provided with a second energy storage means. The emergency procedure operating means are configured for enabling driving of the current switching device and opening the associated electric circuit in an emergency condition in which a lack or drop or irregular supply of the external power line is experienced.

15 Claims, 4 Drawing Sheets

Legend

1 - Switch Unit
2 - Isolated Power Supply
3 - Power Mains or Line
4 - Contactor
5 - Actuator
6 - Power Drive
7 - First Capacitor Bank Section
8 - Electronic Controller (CPU)
9 - Power Supply D/A Part
10 - Power Supply Signal
11 - Input Open Signal Port
12 - Input Close Signal Port
13 - Input Open Signal
14 - Input Close Signal
15 - Input Open Command
16 - External Input Close Command
17 - Open Command
18 - Close Command
20 - Emergency Power Operating Component
21 - Second Capacitor Bank Section
22 - Low Power Main Controller Section
23 - Additional Energy Storage
24 - Backup Capacitor Section
25 - Emergency Power Drive
26 - Step-Up Power Drive
27 - Power Supply Digital Signal
28 - Power Drive Enabling Signal
29 - Emergency Input Open Port
30 - Analog Signal
35 - Charge Signal
100 - Electric Circuit

(56) References Cited

U.S. PATENT DOCUMENTS

| | | | | |
|---|---|---|---|---|
| 5,796,175 | A * | 8/1998 | Itoh | B60L 3/0023 307/10.1 |
| 5,939,799 | A * | 8/1999 | Weinstein | H02J 1/10 307/45 |
| 6,199,145 | B1 * | 3/2001 | Ajanovic | G06F 12/0215 711/105 |
| 6,888,269 | B1 | 5/2005 | Arndt et al. | |
| 6,911,610 | B2 * | 6/2005 | Gemme | H02H 1/06 200/48 R |
| 7,275,622 | B2 * | 10/2007 | Hall | B66B 5/02 187/277 |
| 7,538,826 | B2 * | 5/2009 | Englert | H04N 5/445 348/725 |
| 7,813,818 | B2 * | 10/2010 | Gemme | H02H 1/0092 307/112 |
| 8,154,258 | B2 * | 4/2012 | Pappas | H01G 9/155 320/166 |
| 8,388,170 | B2 * | 3/2013 | Hetrick | F21V 21/00 362/183 |
| 2002/0012258 | A1 * | 1/2002 | Nagai | H02J 9/005 363/95 |
| 2004/0105204 | A1 * | 6/2004 | McElray, Sr. | H02H 3/06 361/71 |

OTHER PUBLICATIONS

Written Opinion (PCT/ISA/237) issued on Jun. 14, 2011, by the European Patent Office as the International Searching Authority for International Application No. PCT/EP2011/053391.

* cited by examiner

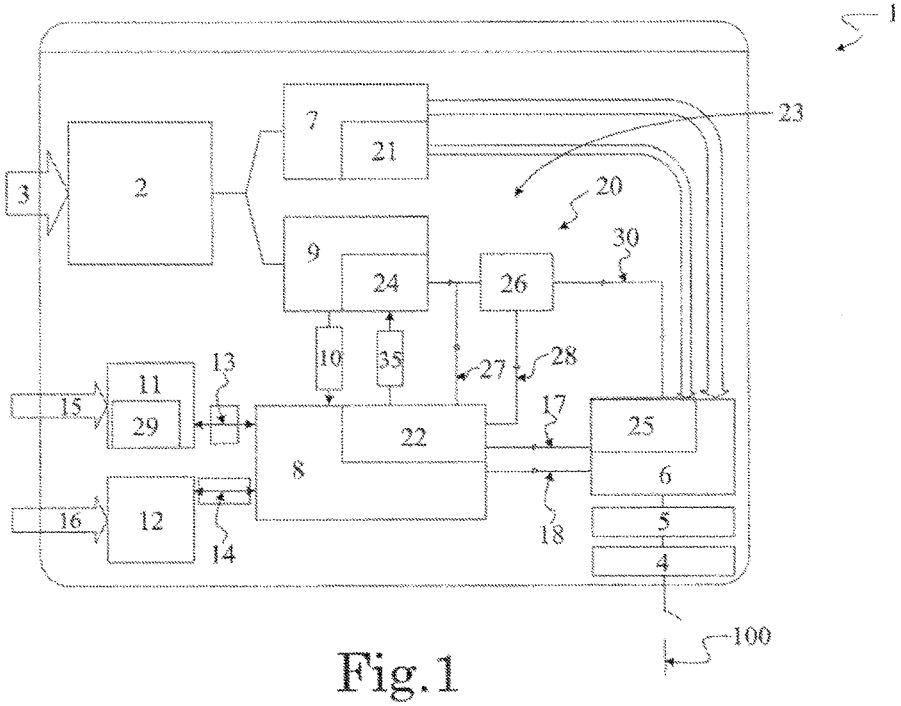

Fig.1

Legend

1 - Switch Unit
2 - Isolated Power Supply
3 - Power Mains or Line
4 - Contactor
5 - Actuator
6 - Power Drive
7 - First Capacitor Bank Section
8 - Electronic Controller (CPU)
9 - Power Supply D/A Part
10 - Power Supply Signal
11 - Input Open Signal Port
12 - Input Close Signal Port
13 - Input Open Signal
14 - Input Close Signal
15 - Input Open Command
16 - External Input Close Command
17 - Open Command
18 - Close Command
20 - Emergency Power Operating Component
21 - Second Capacitor Bank Section
22 - Low Power Main Controller Section
23 - Additional Energy Storage
24 - Backup Capacitor Section
25 - Emergency Power Drive
26 - Step-Up Power Drive
27 - Power Supply Digital Signal
28 - Power Drive Enabling Signal
29 - Emergency Input Open Port
30 - Analog Signal
35 - Charge Signal
100 - Electric Circuit

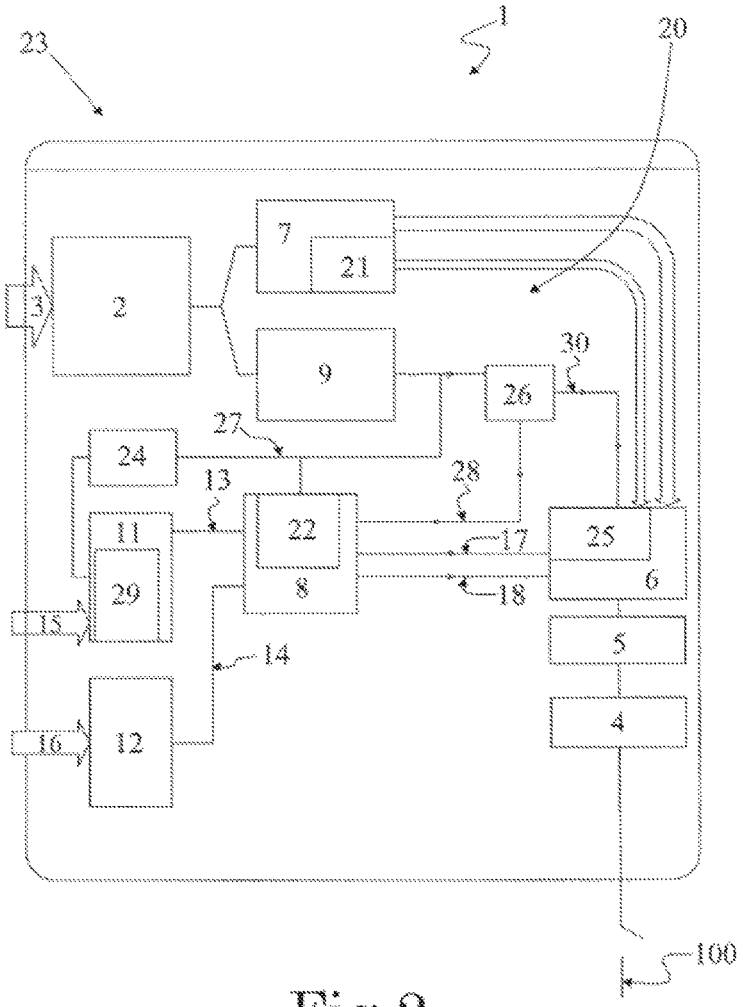

Fig.2

Legend

1 - Switch Unit
2 - Isolated Power Supply
3 - Power Mains or Line
4 - Contactor
5 - Actuator
6 - Power Drive
7 - First Capacitor Bank Section
8 - Electronic Controller (CPU)
9 - Power Supply D/A Part
11 - Input Open Signal Port
12 - Input Close Signal Port
13 - Input Open Signal
14 - Input Close Signal
15 - Input Open Command
16 - External Input Close Command
17 - Open Command
18 - Close Command
21 - Second Capacitor Bank Section
22 - Low Power Main Controller Section
23 - Additional Energy Storage
24 - Backup Capacitor Section
25 - Emergency Power Drive
26 - Step-Up Power Drive
27 - Power Supply Digital Signal
28 - Power Drive Enabling Signal
29 - Emergency Input Open Port
30 - Analog Signal
100 - Electric Circuit

SWITCH UNIT, AND RELATED METHOD

RELATED APPLICATIONS

This application claims priority as a continuation application under 35 U.S.C. §120 to PCT/EP2011/053391, which was filed as an International Application on Mar. 7, 2011 designating the U.S., and which claims priority to European Application 10156853.3 filed in Europe on Mar. 18, 2010. The entire contents of these applications are hereby incorporated by reference in their entireties.

FIELD

The present disclosure relates to a switch unit that is able to reliably perform switching operations in conditions such as a power main drop or lack of power due to plant faults or failures etc. The switch unit according to the present disclosure effectively safeguards end user devices or electric appliances/apparatuses which are operatively connected thereto. The switch unit of the present disclosure is suitable to be used in medium voltage panels or switchboards or other medium voltage appliances.

BACKGROUND INFORMATION

As used herein, the phrase "medium voltage" refers to applications in the range of between 1 KV and some tens of kV.

A medium voltage panel is known to include a contactor for opening/closing an electric circuit. The contactor is driven by an electromagnetic actuator, such as a solenoid actuator. The panel includes a capacitor bank which is charged by an external power main supply and which stores an amount of electric energy that is used for driving the electromagnetic actuator. The panel includes an electronic board which is supplied by the external power main supply. The electronic board operates for enabling the capacitors bank to be charged by the external power main supply and for commanding the electric discharge of electric energy from the capacitor bank to the electromagnetic actuator when required by an operator.

However, known medium voltage panels are limited in their use and functioning in critical situations. For example, in case of a lack of external main power, due for example to faults or failures of the industrial plant in which the panel is installed, the electronic board is not electrically supplied by the external power mains. As a result, the electronic board is not able to drive the contactor in order to open the electric circuit. Therefore, any downstream electric device operatively connected to the panel remains connected to the latter and without being isolated from the electric circuit. Consequently, the integrity of such downstream devices, or of other devices connected to the panel, are not safely preserved, and may be jeopardized by possible damaging events that affect the panel or an overall system in which the panel is included.

SUMMARY

An exemplary embodiment of the present disclosure provides a switch unit which includes a current switching device drivable by an electromagnetic actuator for opening/closing an electric circuit associated with the switch unit, and a first energy storage means for storing an amount of electric energy for the electromagnetic actuator. The exemplary switch unit also includes electronic controller means for controlling a supply of the amount of electric energy from the energy storage means to the electromagnetic actuator. The electronic controller means are suppliable by an external power line. In addition, the exemplary switch unit includes emergency procedure operating means associated with the electronic controller means and including a second energy storage means. The emergency procedure operating means are configured for enabling driving of the current switching device and opening the electric circuit in an emergency condition in which there is a decrease in supply of the external power line.

An exemplary embodiment of the present disclosure provides a method for switching an electric circuit operatively associated with a switch unit including a first energy storage, an electronic controller and a current switching device operatively coupled to an electromagnetic actuator. The exemplary method includes providing in the switch unit a second energy storage, and storing in the first energy storage an amount of electric energy provided by a power line external to the switch unit. The stored energy is suitable to be supplied to the electromagnetic actuator for driving the current switching device to open/close the associated electric circuit. The exemplary method also includes entering an emergency procedure mode in which there is a decrease in supply of the external power line, and supplying the electronic controller through the second energy storage so as to drive the current switching device and open the associated electric circuit when an emergency opening command is generated during the emergency condition.

An exemplary embodiment of the present disclosure provides a switch unit which includes a current switching device drivable by an electromagnetic actuator for opening/closing an electric circuit associated with the switch unit, and a first energy storage for storing an amount of electric energy for the electromagnetic actuator. The exemplary switch unit also includes an electronic controller for controlling a supply of the amount of electric energy from the energy storage to the electromagnetic actuator. The electronic controller is suppliable by an external power line. In addition, the exemplary switch unit includes an emergency procedure operating component associated with the electronic controller and including a second energy storage. The emergency procedure operating component is configured to enable driving of the current switching device and opening the electric circuit in an emergency condition in which there is a decrease in supply of the external power line.

BRIEF DESCRIPTION OF THE DRAWINGS

Additional refinements, advantages and features of the present disclosure are described in more detail below with reference to exemplary embodiments illustrated in the drawings, in which:

FIG. 1 is a schematic circuit block diagram of a switch unit according to an exemplary embodiment of the present disclosure;

FIG. 2 is schematic circuit block diagram of a switch unit according to an exemplary embodiment of the present disclosure;

DETAILED DESCRIPTION

Figure 3:
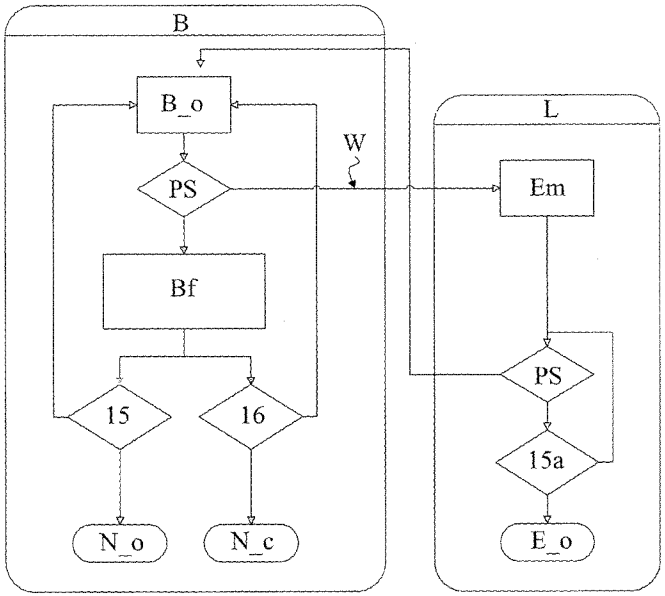
FIG. 3 is a flowchart showing operating steps of a switch unit according to an exemplary embodiment of the present disclosure.

Exemplary embodiments of the present disclosure provide improvements to known medium voltage panels.

Exemplary embodiments of the present disclosure provide a switch unit, which can be associated with a medium voltage panel, and which is able to reliably operate in critical conditions, such as in case of a lack or drop of external main power supply due, for example, to a fault or failure of the plant to which the switch unit is connected.

An exemplary embodiment of the present disclosure provides a switch unit which includes a current switching device drivable by an electromagnetic actuator for opening/closing an electric circuit associated with the switch unit, and a first energy storage means for storing an amount of electric energy for the electromagnetic actuator. The exemplary switch unit also includes electronic controller means for controlling a supply of the amount of electric energy from the energy storage means to the electromagnetic actuator. The electronic controller means are suppliable by an external power line. In addition, the exemplary switch unit includes emergency procedure operating means associated with the electronic controller means and including a second energy storage means. The emergency procedure operating means are configured for enabling driving of the current switching device and opening the electric circuit in an emergency condition in which there is a decrease in supply of the external power line.

An exemplary embodiment of the present disclosure provides a method for switching an electric circuit operatively associated with a switch unit including a first energy storage, an electronic controller and a current switching device operatively coupled to an electromagnetic actuator. The exemplary method includes providing in the switch unit a second energy storage, and storing in the first energy storage an amount of electric energy provided by a power line external to the switch unit. The stored energy is suitable to be supplied to the electromagnetic actuator for driving the current switching device to open/close the associated electric circuit. The exemplary method also includes entering an emergency procedure mode in which there is a decrease in supply of the external power line, and supplying the electronic controller through the second energy storage so as to drive the current switching device and open the associated electric circuit when an emergency opening command is generated during the emergency condition.

Due to the features of the present disclosure, it is possible for a stored amount of energy to be used in an optimal way and an emergency switching operation, if requested, is ensured even if the external main power is missing.

In accordance with an exemplary embodiment, as will be better understood from the following description, the switch unit is configured so as to be able to continuously monitor a main power supply and to enter a low-consumption mode when a lack of main power is detected. If an opening command occurs while a lack of external power supply is being experienced, or when the external main power supply is below a given threshold (e.g., it is lower than an acceptable operative value), the switch unit temporarily reactivates only the peripheral devices or components associated therewith which are necessary for performing the opening command.

Further characteristics and advantages of the present disclosure are described in more detail below with reference to exemplary embodiments illustrated in the drawings.

With reference to FIG. 1, a switch unit 1 is shown for opening/closing an associated electric circuit schematically indicated by the reference number 100.

The switch unit 1 can be used, for example, in a non-limiting way, in medium voltage panels or switchboards, or switchgear, or in connection with other medium voltage apparatuses or devices. In turn, the electric circuit 100 can be, for example, but not limited to, a section of a grid, a load, etc.

The switch unit 1 includes an isolated power supply 2 which is connectable to an external power line/mains 3 from which electric energy is received for operating in normal conditions.

The switch unit 1 includes a current switching device 4 for opening/closing the electric circuit 100. According to an exemplary embodiment, the switching device includes a medium voltage contactor 4. For example, the contactor can be the so called-"V-Contact VSC" marketed by ABB Group; alternatively, any type of contactor suitable for performing the functionalities required may be used.

An actuator 5, for example, a bistable electromagnetic actuator, is included in the switch unit 1 for driving the contactor 4, and includes at least one coil. Any suitable electromagnetic actuator available on the market can be used in the switching unit 1 according to the present disclosure.

A power drive 6 is configured for electrically activating the coil of the actuator 5 so as to move a movable contact of the contactor 4, thereby opening or closing the associated electric circuit 100. Therefore, the power drive 6 is configured for functioning in normal operating conditions of the switch unit 1 and causing (together with the actuator 5 and the contactor 4) both opening or closing of the associated electric circuit 100 according to operations which are known in the art and therefore will not be described herein in further detail.

The switch unit 1 is provided with an energy storage 7 (e.g., energy storage means), which may include, for example, a first capacitor bank section 7, operatively connected to the isolated power supply 2 and to the power drive 6. The energy storage 7 may hereinafter be referred to as a first energy storage or first energy storage means.

The first capacitor bank section 7 is charged by the isolated power supply 2 with electric energy supplied by the external power mains or line 3. For example, the first capacitor bank section 7 supplies, on request, the stored amount of electric energy to the actuator 5, for opening or closing the electric circuit during normal operating of the switch unit 1, i.e. in normal operating conditions.

The switch unit 1 also includes an electronic controller 8 (e.g., electronic controller means) for handling basic functions and emergency procedures. Basic functions are performed within a basic management mode (B) of operating of the switch unit 1, as shown in FIG. 3. Basic functions (Bf), or basic operations, include actuating the contactor 4 in normal operating conditions, for example, opening or closing of the contactor 4, and other activities which are performed under normal operating conditions.

Differently, with the term "emergency procedures" reference is made to an operating condition which implies a low power consumption due to a lack of, drop in, irregular supply, or cessation of main external power to the switch unit 1. In this case, the switch unit 1 operates in a low power management mode (L) (shown in FIG. 3), as will be explained in more detail hereinafter. In particular, an emergency procedure includes a procedure that enables driving of the contactor 4 for opening the associated electric circuit 100, during lack of main power supply from the external line 3. In an emergency procedure, any peripheral (unit, device, circuit or part thereof) included in the switch unit 1 or operatively connected to, and in particular operatively connected to the electronic controller 8, is completely switched off or put in an operative low-consumption mode, for example, in stand-by, thus enabling effective energy saving as will result from the following description.

The electronic controller 8 is configured for operating the first capacitor bank section 7 and the actuator 5. The electronic controller 8 includes a microcontroller, such as a CPU 8 (Central Processing Unit) having a processor. The CPU 8 is electrically supplied by a power supply digital/analog part 9 which is in turn supplied by the isolated power supply 2.

The CPU 8 is able to detect a power supply signal 10 from the power supply digital/analog part 9. According to an exemplary embodiment, the switch unit 1 is provided with a power fail detector through which a possible failure condition of the external power supply from the line 3 (power completely shut-down or dropped below an acceptable operative value) is recognized by the CPU 8. In this way, the external power supply can be continuously monitored by the CPU 8.

The switch unit 1 includes an input open signal port 11 through which an external input open command 15 can be received, for opening the electric circuit, and an input close signal port 12, through which an external input close command can be received, for closing the electric circuit 100.

In normal operating conditions, when an input open command 15 arrives at the input open signal port 11, an input open signal 13 is generated to the CPU 8 which, in turn, sends an open command 17 to the power drive 6, so as to drive the contactor 4, thus opening the circuit 100.

In normal operating conditions, when an input close command 16 arrives at the input close signal Port 12, an input close signal 14 is generated towards the CPU 8 which, in turn, sends a close command 18 to the power drive 6, so as to drive the contactor 4, thus closing the circuit 100.

The switch unit 1 includes an emergency procedure operating component 20 (e.g., emergency procedure operating means) configured for enabling the electronic controller 8 to also operate in an emergency condition, for example, in situations in which a lack or drop of the main power from the external line 3 occurs, or an irregular supply of the external main power is experienced, for example if the external power supply goes below a given threshold (lower than an acceptable operative value).

Owing to the emergency procedure operating component 20, driving of the contactor 4 is also possible in an emergency condition, when it is required.

The emergency procedure operating component 20 is associated with the electronic controller 8. For example, at least part of the emergency procedure operating unit 20 is embedded in the electronic controller 8.

In particular, the emergency procedure operating component 20 includes a low power main controller section 22, which is included in the electronic controller 8, and which performs, through a proper applicative software executed by the processor of the CPU 8, the low power management procedure, that is, it enables the switch unit 1 to be in a state condition that allows for preservation of energy. In other words, the low power main controller section 22 is a subset of the CPU 8 which is able to manage low power conditions.

The emergency procedure operating component 20 includes an emergency power drive 25 for opening the contactor 4 in an emergency situation, for example, to drive the coil of the actuator 5 for opening the contactor 4. The emergency power drive 25 can be a separate drive, or embedded into the power drive 6, or just part of the power drive 6 itself.

The emergency procedure operating means 20 includes also a step-up power drive 26 which is operatively connected to the low power main controller section 22, and to the emergency power drive 25, and an additional energy storage indicated by the reference number 23. The additional energy storage 23 may hereinafter be referred to as a second energy storage or second energy storage means The additional energy storage 23 includes a backup capacitor section 24 which is also operatively connected to the step-up power drive 26, and a second capacitor bank section 21 which serves to electrically supply the emergency power Drive 25, and which is managed by the low power main controller section 22.

In accordance with an exemplary embodiment, the first capacitor bank section 7 and the second capacitor bank section 21 can be completely separated energy storage units and may respectively include a first capacitor or a first capacitor bank and a second capacitor or a second capacitor bank, which are distinct from one another. In another exemplary embodiment, the first capacitor bank section 7 and the second capacitor bank 21 are both part of a single capacitor or of a single capacitor bank. In the example disclosed herein with reference to the attached drawings, the first capacitor bank section 7 and the second capacitor bank section 21 are both included in a single and the same capacitor. This means that the first capacitor bank section 7 is a fraction of such a capacitor intended to operate during normal condition functioning of the switch unit 1, and the second capacitor bank section 21 is a further fraction of the capacitor intended to operate during an emergency condition functioning of the switch unit 1, which implies a low power consumption.

The step-up power drive 26, upon a power supply digital signal 27 and a power drive enabling signal 28 are generated, generates and sends an analog signal 30, for example, a signal for activating voltage, to the emergency power Drive 25 and allows electric energy to be supplied from the second capacitor bank section 21 to the emergency power drive 25, thus opening the electric circuit.

A request to open the circuit 100 associated with the switching unit 1 in an emergency situation can be given, for example, by a user through a dedicated emergency input open port 29.

Figure 4:
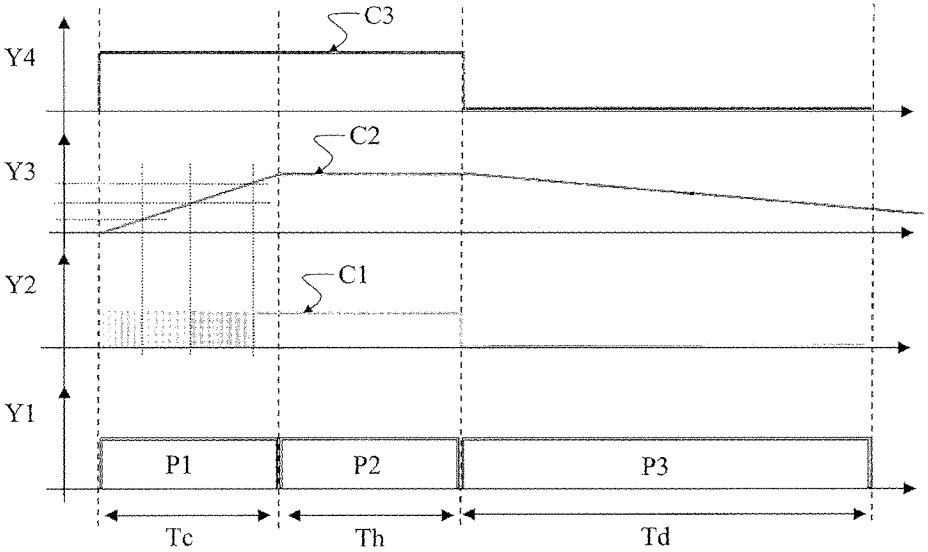
FIG. 4 is a behaviour diagram of a switch unit according to an exemplary embodiment of the present disclosure.

The backup capacitor section 24 supplies energy to the digital/analog section 9 and includes a capacitor bank which is charged at a proper value, as shown by the charging behaviour curve C1, at the Y2 ordinate in FIG. 4. The backup capacitor section 24 is charged by the external power supply 3 only once for a time charge (Tc), e.g., a few seconds, in a first phase P1, at start-up of the system into or to which the switch unit 1 is included or connected. The behavior of the backup capacitor section 24 voltage is shown by the voltage behavior curve C2 in FIG. 4.

The backup capacitor section 24 is managed by the CPU 8 which reads the power supply voltage through the power supply signal 10 and activates charging of the backup capacitor section 24, through a charge signal 35. During a first phase P1, other activities can be executed at full CPU speed. After the first phase P1, the electric charge is hold in a second phase P2, for a holding time Th, in which the switch unit 1 operates in normal conditions. During the second phase P2, the CPU 8 runs at maximum speed and all functions are guaranteed.

FIG. 2 shows an exemplary embodiment of the switch unit 1 according to the present disclosure, differing from the version of FIG. 1 in that the backup capacitor section 24 is not embedded in the power supply digital/analog part 9, and is directly operatively connected to the input open signal port 11.

During functioning in normal conditions (basic management mode), for example, in the second phase P2, a basic operation (B_o) of the switch unit 1 takes place (see FIG. 3), and basic functions (Bf), such as charging of the capacitor banks, serial port communication operations, and normal opening/closing operations of the contactor 4, are performed.

Power supply (PS) is continuously monitored by the CPU 8. Upon an external open request, for example, upon an input open command 15, the switch unit 1 performs a normal circuit opening (N_o). Upon an external close request, for example, upon an input close command 16, the switch unit 1 performs a normal circuit closing (N_c).

During functioning, if a drop of the voltage level related to the power fed by the line 3 under an acceptable level is detected by the CPU 8, the switch unit 1 goes into the low power management mode (L).

For example, the low power main controller section 22 goes into a low power main controller function mode (as shown in FIG. 3 by first arrow W), in an emergency operation (Em) condition, so as to reduce the overall power consumption. The behavior in this third phase P3 is shown by the external power supply curve C3 in FIG. 4.

During the third phase P3, in which the external power supply 3 is in a failure condition (e.g., shut-down, or a drop below an acceptable operative value), the charge of the back-up capacitor section 24 progressively runs out. The CPU 8 enters the low power main controller function mode and the power to the electronic controller 8, and in particular to the power main controller section 22 will be given by the back-up capacitor section 24.

In accordance with an exemplary embodiment, during this third phase P3 various possible activities/functions carried out in normal conditions are left either at full "sleep mode" or completely switched off, just waiting for restoration of the main external power supply or for an external opening command request.

In this situation, the power main controller section 22 puts itself and the entire CPU 8 in an energy low-consumption mode and drains power from the back-up capacitor section 24; the amount of power drained from the back-up capacitor section 24 is, for a predetermined time, enough basically for: continuing to monitor the power supply (Ps) from the main power line 3 (the power signal 10 from the power supply digital/analog part 9 is checked); and checking if an emergency opening command 15 is received (at the input open signal port 11 or at 29). At the same time, the main controller section 22 substantially freezes the second capacitor bank section 21 with the actual residual level of energy stored therein when entering the low power management mode L. In addition, the main controller section 22 switches completely off and/or puts in a stand-by mode (low-energy consumption mode) all peripherals, e.g. devices, units, communications functions, circuits or parts thereof, and the like, operatively associated with or included in the switch unit and operatively connected to the electronic controller 8, which peripherals are not strictly needed to perform monitoring of the power supply (Ps) from the main power line 3 and checking if an emergency opening command 15*a* is received. Such peripherals may include, for example but not limited to, dip-switches, external serial ports, as well as the emergency power drive 25, the step-up power drive 26, etc.

Hence, in this condition, if the main power from the power line 3 is correctly restored, the CPU 8 enters again the basic management mode (B) condition. If instead, an emergency opening command 15*a* occurs, while a lack of main power is being experienced, the CPU 8 temporarily reactivates any peripheral required to perform such a command and open the circuit. In other words, the emergency power drive 25 is re-activated, thus acting on the solenoid of the actuator 5, by using the residual energy stored and conserved into the second capacitor bank section 21.

This operation is shown in FIG. 4 at phase P3, during which a discharge of the stored energy occurs during discharge time Td. This operation is also shown in FIG. 3 and is referenced to as emergency opening (E_o).

Owing to this switch unit 1 configuration, by switching off or putting a stand-by low consumption mode any peripheral not strictly needed, waste of energy is avoided thus enabling the CPU system clock to slow down. The operability of the switch unit 1 is guaranteed a few hours, according to the auto discharge characteristic of the energy storage means used.

Differently from and advantageously with respect to known devices, an opening of the circuit is therefore possible despite the lack of external power supply, owing to the switch unit of the disclosure as above configured. During a power fail, a closing operation of the electric circuit may not be allowed. The CPU 8, for example, the low power main controller section 22, supervises the correctness and completion of the opening operation of the circuit. The switch unit 1 according to the present disclosure thus enables a high safety level to be obtained for a user, and enables to effectively and reliably safeguard any end devices or electric appliances which are operatively connected to, and/or operated by the switch unit 1 itself.

Possible variants and/or additions to the switch unit 1, and any medium voltage panel including the same, can be provided. In particular, the switch unit 1 discussed above may undergo modifications and/or may be implemented in many different versions, and any part of the switch unit 1 herein disclosed may be replaced by a corresponding technically equivalent component according to desired requirements, all coming within the scope of the present disclosure as defined in the appended claims.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A switch unit comprising:

a current switching device drivable by an electromagnetic actuator for opening/closing an electric circuit associated with the switch unit;

a first energy storage means for storing an amount of electric energy for the electromagnetic actuator;

electronic controller means for controlling a supply of the amount of electric energy from the first energy storage means to the electromagnetic actuator, the electronic controller means being suppliable by an external power line;

emergency procedure operating means associated with the electronic controller means and including a second energy storage means, the emergency procedure operating means being configured for enabling driving of the current switching device and opening the electric circuit in an emergency condition in which there is a decrease in supply of the external power line;

wherein the first energy storage means is electrically connected to the electromagnetic actuator when the emergency procedure operating means enables driving of the current switching device and opens the electric circuit upon detection of an emergency opening event during the emergency condition; and an input open signal port and an input close signal port, for respectively receiving an external input open command and an external input close command for opening and closing the electric circuit during normal operating conditions;

wherein the emergency procedure operating means include an emergency input open port for receiving an emergency open command for opening the electric circuit in the emergency condition, and a close command for closing the electric circuit is not allowed in the emergency condition;

wherein the second energy storage means include a second capacitor bank section;

wherein the emergency procedure operating means include a low power main controller section included in the electronic controller means and supplied by the second energy storage means;

wherein the low power main controller section is configured to switch off or put into stand-by mode one or more peripherals operatively associated with the electronic controller means when entering the emergency condition; and wherein the low power main controller section is configured to put the electronic controller means into a stand-by mode and to freeze the second capacitor bank section with an actual residual level of energy stored therein when entering the emergency condition.

2. The switch unit according to claim 1, wherein the first energy storage means include a first capacitor bank section, and the second energy storage means include a backup capacitor section.

3. The switch unit according to claim 2, wherein the second capacitor bank section and the first capacitor bank section are both part of a single capacitor or of a single capacitor bank.

4. The switch unit according to claim 1, comprising:

a power drive supplied by the first energy storage means, for driving the electromagnetic actuator, wherein the emergency procedure operating means include an emergency power drive supplied by the second energy storage means for driving the current switching device in the emergency condition.

5. The switch unit according to claim 4, wherein the emergency procedure operating means include a step-up power drive which is operatively connected to the low power main controller section and which is configured to active the emergency power drive.

6. The switch unit according to claim 1, comprising:

a power fail detector for detecting the emergency condition, wherein the emergency procedure operating means are configured to monitor a state of the external power line and checking whether the emergency opening command is received during operation in the emergency condition.

7. A medium voltage panel comprising a switch unit according to claim 1.

8. The switch unit according to claim 1, wherein the decrease in supply of the external power line includes at least one of a lack of supply of the external power line, a drop in supply of the external power line, and an irregular supply of the external power line.

9. A method for switching an electric circuit operatively associated with a switch unit including a first energy storage, an electronic controller and a current switching device operatively coupled to an electromagnetic actuator, wherein the method comprises:

providing in the switch unit a second energy storage;

storing in the first energy storage an amount of electric energy provided by a power line external to the switch unit, the stored energy suitable to be supplied to the electromagnetic actuator for driving the current switching device to open/close the associated electric circuit;

entering an emergency procedure mode in which there is a decrease in supply of the external power line; and supplying the electronic controller through the second energy storage so as to drive the current switching device and open the associated electric circuit when an emergency opening command is generated during the emergency condition, wherein the first energy storage is electrically connected to the electromagnetic actuator when, in response to an emergency operating event detected during the emergency condition, the electronic controller is supplied through the second energy storage to drive the current switching device and open the associated electric circuit during the emergency condition; and receiving an external input open command and an external input close command for opening and closing the electric circuit during normal operating conditions;

wherein the emergency procedure mode includes receiving an emergency open command for opening the electric circuit in the emergency condition, and a close command for closing the electric circuit is not allowed in the emergency condition;

wherein the entering of the emergency procedure mode includes, when entering the emergency condition, switching off or putting into stand-by mode one or more peripherals operatively associated with the electronic controller; and wherein the entering of the emergency procedure mode includes, when entering the emergency condition, putting the electronic controller into a stand-by mode and freezing at least part of the second energy storage with an actual residual level of energy stored therein.

10. The method according to claim 9, comprising: monitoring a state of the external power line and checking whether the emergency opening command is received during operation in the emergency condition.

11. The method according to claim 9, comprising at least one of: entering a basic management mode of normal operating conditions, when a restoration of the external power line from the Emergency condition is detected; and supplying the residual energy in at least part of the second energy storage for moving the electromagnetic actuator and opening the associated electric circuit when an emergency opening command is received during the emergency condition.

12. The method according to claim 9, wherein the decrease in supply of the external power line includes at least one of a lack of supply of the external power line, a drop in supply of the external power line, and an irregular supply of the external power line.

13. A switch unit comprising:

a current switching device drivable by an electromagnetic actuator for opening/closing an electric circuit associated with the switch unit;

a first energy storage for storing an amount of electric energy for the electromagnetic actuator;

an electronic controller for controlling a supply of the amount of electric energy from the energy storage to the electromagnetic actuator, the electronic controller being suppliable by an external power line; and an emergency procedure operating component associated with the electronic controller and including a second energy storage, the emergency procedure operating component being configured to enable driving of the current switching device and opening the electric circuit in an emergency condition in which there is a decrease in supply of the external power line, wherein the first energy storage is electrically connected to the electromagnetic actuator when, upon detection of an emergency opening event, the emergency procedure operating component enables driving of the current switching device and opens the electric circuit during the emergency condition, and wherein, upon detection by the electronic controller of a power restoration event during the emergency condition, the emergency procedure operating means enables at least a portion of the switch unit to exit a low power management mode; and an input open signal port and an input close signal port, for respectively receiving an external input open command and an external input close command for opening and closing the electric circuit during normal operating conditions;

wherein the emergency procedure operating component includes an emergency input open port for receiving an emergency open command for opening the electric circuit in the emergency condition, and a close command for closing the electric circuit is not allowed in the emergency condition;

wherein the second energy storage includes a second capacitor bank section;

wherein the emergency procedure operating component includes a low power main controller section included in the electronic controller and supplied by the second energy storage;

wherein the low power main controller section is configured to switch off or put into stand-by mode one or more peripherals operatively associated with the electronic controller when entering the emergency condition; and wherein the low power main controller section is configured to put the electronic controller into a stand-by mode and to freeze the second capacitor bank section with an actual residual level of energy stored therein when entering the emergency condition.

14. The switch unit according to claim 13, wherein the decrease in supply of the external power line includes at least one of a lack of supply of the external power line, a drop in supply of the external power line, and an irregular supply of the external power line.

15. A switch unit comprising:

a current switching device drivable by an electromagnetic actuator for opening/closing an electric circuit associated with the switch unit;

a first energy storage means for storing an amount of electric energy for the electromagnetic actuator;

electronic controller means for controlling a supply of the amount of electric energy from the first energy storage means to the electromagnetic actuator, the electronic controller means being suppliable by an external power line;

emergency procedure operating means associated with the electronic controller means and including a second energy storage means, the emergency procedure operating means being configured for enabling driving of the current switching device and opening the electric circuit in an emergency condition in which there is a decrease in supply of the external power line;

wherein the first energy storage means is electrically connected to the electromagnetic actuator when the emergency procedure operating means enables driving of the current switching device and opens the electric circuit upon detection of an emergency opening event during the emergency condition; and an input open signal port and an input close signal port, for respectively receiving an external input open command and an external input close command for opening and closing the electric circuit during normal operating conditions; and a power drive supplied by the first energy storage means, for driving the electromagnetic actuator, wherein the emergency procedure operating means include an emergency input open port for receiving an emergency open command for opening the electric circuit in the emergency condition, and a close command for closing the electric circuit is not allowed in the emergency condition;

wherein the emergency procedure operating means include a low power main controller section included in the electronic controller means and supplied by the second energy storage means;

wherein the low power main controller section is configured to switch off or put into stand-by mode one or more peripherals operatively associated with the electronic controller means when entering the emergency condition;

wherein the emergency procedure operating means include an emergency power drive supplied by the second energy storage means for driving the current switching device in the emergency condition; and wherein the emergency procedure operating means include a step-up power drive which is operatively connected to the low power main controller section and which is configured to active the emergency power drive.

* * * * *